US010622753B2

(12) United States Patent
Church-Diciccio et al.

(10) Patent No.: US 10,622,753 B2
(45) Date of Patent: Apr. 14, 2020

(54) HIGH SPEED DATA MODULE VERTICAL INSERT

(71) Applicant: Virginia Panel Corporation, Waynesboro, VA (US)

(72) Inventors: Christopher Church-Diciccio, Waynesboro, VA (US); David Rocker, Earlysville, VA (US)

(73) Assignee: Virginia Panel Corporation, Waynesboro, VA (US)

( * ) Notice: Subject to any disclaimer, the term of this patent is extended or adjusted under 35 U.S.C. 154(b) by 0 days.

(21) Appl. No.: 16/131,074

(22) Filed: Sep. 14, 2018

(65) Prior Publication Data

US 2019/0081432 A1 Mar. 14, 2019

Related U.S. Application Data

(60) Provisional application No. 62/558,449, filed on Sep. 14, 2017.

(51) Int. Cl.
*H01R 43/24* (2006.01)
*H01R 13/504* (2006.01)
(Continued)

(52) U.S. Cl.
CPC ..... *H01R 13/504* (2013.01); *H01R 13/405* (2013.01); *H01R 13/514* (2013.01);
(Continued)

(58) Field of Classification Search
CPC ..... H01R 2107/00; H01R 12/716; H01R 12/721; H01R 12/737; H01R 24/60; H01R 31/06; H01R 12/7005; H01R 13/6272; H01R 24/62; H01R 24/64; H01R 33/94; H01R 12/7047; H01R 12/714; H01R 12/724; H01R 12/73; H01R 12/79; H01R 13/6275; H01R 13/629; H01R 13/639; H01R 12/712; H01R 12/718; H01R 12/75; H01R 13/113; H01R 13/514; H01R 13/6205; H01R 13/6273; H01R 13/6471; H01R 13/6583; H01R 13/6683; H01R 27/00; H01R 12/58; H01R 12/585; H01R 12/596; H01R 12/62; H01R 12/7023; H01R 12/7052; H01R 12/707; H01R 12/71; H01R 12/72; H01R 12/725; H01R 12/732; H01R 12/735; H01R 12/775; H01R 13/02; H01R 13/03; H01R 13/04; H01R 13/11; H01R 13/112; H01R 13/115; H01R 13/2442; H01R 13/26; H01R 13/405; H01R 13/44; H01R 13/504; H01R 13/506; H01R 13/512; H01R 13/516; H01R 13/518; H01R 13/53; H01R 13/567; H01R 13/6215;
(Continued)

(56) References Cited

U.S. PATENT DOCUMENTS 5,795,191 A * 8/1998 Preputnick ..... H01R 13/6587 439/607.11
6,021,048 A * 2/2000 Smith ..... H05K 1/144 361/736

(Continued)

*Primary Examiner* — Truc T Nguyen
(74) *Attorney, Agent, or Firm* — 24IP Law Group USA, PLLC; Timothy Dewitt

(57) ABSTRACT

A vertical insert and pass-thru for high speed contact sets or modules for use with high life-cycle or mass interconnect devices.

5 Claims, 8 Drawing Sheets

(51) Int. Cl.

| | |
|---|---|
| ***H01R 13/514*** | (2006.01) |
| ***H01R 13/6585*** | (2011.01) |
| ***H01R 13/627*** | (2006.01) |
| ***H01R 13/405*** | (2006.01) |
| *H01R 24/84* | (2011.01) |
| *H01R 13/516* | (2006.01) |

(52) U.S. Cl.
CPC ..... *H01R 13/6273* (2013.01); *H01R 13/6585* (2013.01); *H01R 43/24* (2013.01); *H01R 13/516* (2013.01); *H01R 24/84* (2013.01)

(58) Field of Classification Search
CPC ..... H01R 13/631; H01R 13/6315; H01R 13/6335; H01R 13/64; H01R 13/6463; H01R 13/6467; H01R 13/6469; H01R 13/6474; H01R 13/648; H01R 13/6581; H01R 13/6582; H01R 13/6585; H01R 13/6587; H01R 13/6594; H01R 13/6658; H01R 13/6675; H01R 13/6691; H01R 13/7039; H01R 13/7175; H01R 13/73; H01R 13/74; H01R 2201/06; H01R 2201/26; H01R 24/22; H01R 24/50; H01R 24/84; H01R 27/02; H01R 31/005; H01R 31/065; H01R 33/0845; H01R 33/97; H01R 43/205; H01R 43/26; H01R 4/023; H01R 9/034
See application file for complete search history.

(56) References Cited

U.S. PATENT DOCUMENTS

| | | | | |
|---|---|---|---|---|
| 7,227,759 | B2 * | 6/2007 | Grundy | H01R 23/70 361/785 |
| 2004/0092168 | A1 * | 5/2004 | Vadasz | H01R 12/721 439/631 |
| 2011/0212650 | A1 * | 9/2011 | Amleshi | H01R 13/514 439/660 |
| 2014/0341513 | A1 * | 11/2014 | Lin | G02B 6/4272 385/89 |
| 2015/0050843 | A1 * | 2/2015 | Jeon | H01R 13/6477 439/682 |
| 2015/0087175 | A1 * | 3/2015 | Stowers | H01R 13/502 439/284 |
| 2015/0092363 | A1 * | 4/2015 | Blier | H05K 1/189 361/749 |
| 2018/0254571 | A1 * | 9/2018 | Herring | H01R 12/721 |

* cited by examiner

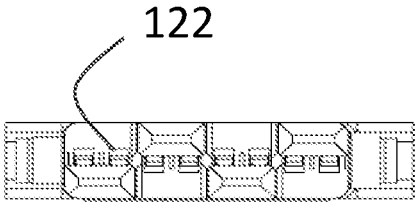
FIG. 1C
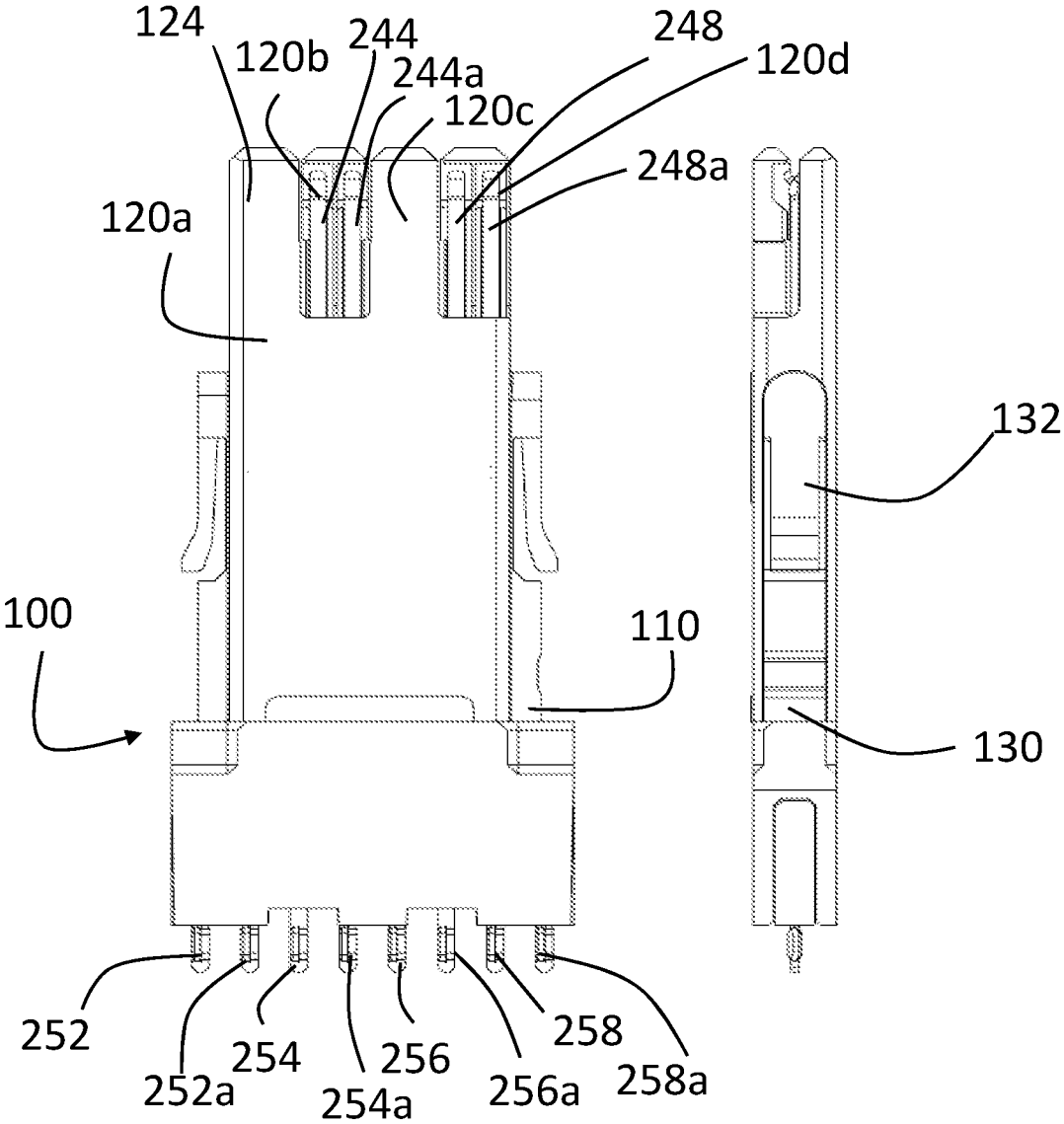
FIG. 1A
FIG. 1B

HIGH SPEED DATA MODULE VERTICAL INSERT

CROSS-REFERENCE TO RELATED APPLICATIONS

The present application claims the benefit of the filing dates of U.S. Provisional Patent Application Ser. No. 62/558,449 filed by the present inventors on Sep. 14, 2017.

The present invention further is related to U.S. Pat. Nos. 9,246,286 and 9,685,727.

The aforementioned patents and provisional patent application are hereby incorporated by reference in their entirety.

STATEMENT REGARDING FEDERALLY SPONSORED RESEARCH OR DEVELOPMENT

None.

BACKGROUND OF THE INVENTION

Field of the Invention

The present invention relates to high-speed data contacts, and more particularly, a vertical insert for high speed contact sets or modules for use with high life-cycle or mass interconnect devices.

Brief Description of the Related Art

A variety of high speed data contacts have been developed and used along with various modules for housing such high speed data contacts. Examples include those disclosed in U.S. Patent Application Publication No. 2013/0102199, entitled "Hermaphroditic Interconnect System," U.S. Patent Application Publication No. 2011/0177699 entitled "Backplane Cable Interconnection," U.S. Patent Application Publication No. 2010/0248522 entitled "Electrical Cable Connection Latch System" and U.S. Pat. No. 7,316,579, entitled "Zero Insertion Force Cable Interface." Additional high speed data contact system are known, for example, as the "FCI Examax." While these prior high speed data contact systems had various advantages, none were specifically adapted for use in high life cycle systems designed to perform for thousands or tens of thousands of connection cycles or for mass interconnect systems.

A variety of high life cycle and mass interconnect devices for use with various contacts are known. One example of a conventional high life-cycle interconnect device or interface system is the mass interconnect device disclosed in U.S. Pat. No. 4,329,005, entitled "Slide Cam Mechanism for Positioning Test Adapter in Operative Relationship with a Receiver." Other prior art engagement systems include those disclosed in U.S. Pat. Nos. 5,966,023, 5,562,458, 7,297,014, U.S. Patent Application Publication No. 2010/0194417 and U.S. Pat. No. 8,348,693.

More recently, U.S. Pat. Nos. 9,246,286 and 9,685,727 disclosed high speed data modules. The above patents and published applications are hereby incorporated by reference in their entirety.

SUMMARY OF THE INVENTION

In a preferred embodiment, the present invention is a vertical insert for high speed contact sets or modules for use with high life-cycle or mass interconnect devices.

Still other aspects, features, and advantages of the present invention are readily apparent from the following detailed description, simply by illustrating a preferable embodiments and implementations. The present invention is also capable of other and different embodiments and its several details can be modified in various obvious respects, all without departing from the spirit and scope of the present invention. Accordingly, the drawings and descriptions are to be regarded as illustrative in nature, and not as restrictive. Additional objects and advantages of the invention will be set forth in part in the description which follows and in part will be obvious from the description, or may be learned by practice of the invention.

BRIEF DESCRIPTION OF THE DRAWINGS

For a more complete understanding of the present invention and the advantages thereof, reference is now made to the following description and the accompanying drawings, in which:

FIG. 1A is a top view of a high speed data module vertical insert in accordance with a preferred embodiment of the present invention.

FIG. 1B is a side view of a high speed data module vertical insert in accordance with a preferred embodiment of the present invention.

FIG. 1C is a front end view of a high speed data module vertical insert in accordance with a preferred embodiment of the present invention.

DETAILED DESCRIPTION OF THE PREFERRED EMBODIMENTS

Figure 2A:
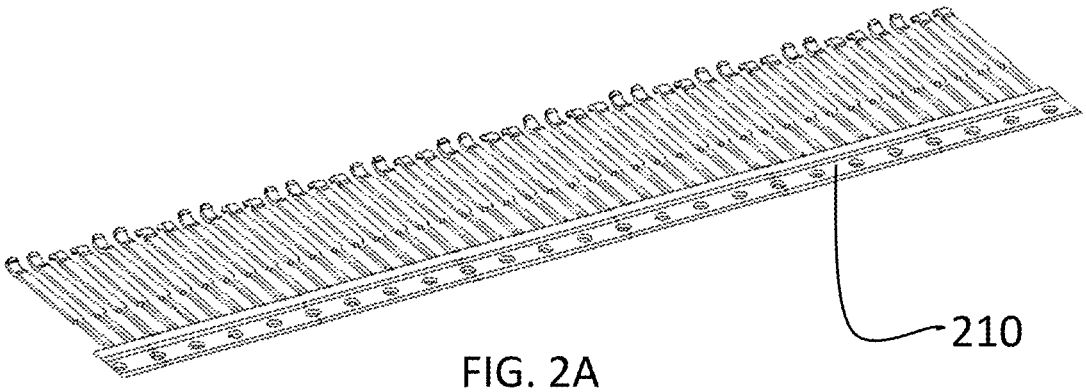
FIG. 2A is a perspective view of a sheet of high speed contacts in accordance with a preferred embodiment of the present invention.

The preferred embodiments of the inventions are shown and labelled in the accompanying drawings.

In a preferred embodiment the present invention is a high speed data module vertical insert for use with high life cycle or mass interconnect systems. The high speed data module vertical insert of a preferred embodiment of the present invention has a housing or shroud 100 that includes multistage lead-in features and controlled float to pre-align contacts during engagement and thereby extends the cycle life of the contacts. The housing 100, shown in FIG. 1, is formed, for example, from a non-conductive material such as plastic. The housing 100 has a hollow body 110 having a plurality of protective arms 120*a*, 120*b*, 120*c*, and 120*d* extending from the distal portion of the body 110. The end of each protective arm 120*a*, 120*b*, 120*c*, and 120*d* has one or more beveled or angled edges 122 for providing a first stage of pre-alignment of contacts during engagement, for example, with another chiclet. On each side of each protective arm there is an angled shoulder 124 for providing a second stage of pre-alignment of contacts. The housing body 110 has a latch 130 on each side for holding the latch in a module after insertion. The latches 130 are biased away from the body 110 and have angled portions 132 extending away from the hollow body 110. The portions 132 may include beveled or angled corners and edges to prevent snagging and/or breakage when the shroud is removed from a module. The latches make the insert shrouds individually removable from a module of a receiver or test adapter frame. Also, on each side the housing body 110 may have keying members. For example, two module keying members may be of different sizes, thereby allowing insertion of the insert into a module in only one orientation, thereby preventing human errors in setting up an interface system. On top of the housing body 110 there may be raised bosses for providing alignment of the housing body 110 with an adjacent housing body when a plurality of inserts are stacked together. At the base of each raised boss there may be an annular spacing ridge. The top of the housing body 110 further may have a hole through which potting material may be injected. Also, on the top of the housing body 110 there may be a slot that may be used, for example, to release another connector that has been inserted into the rear of the insert.

Figure 2B:
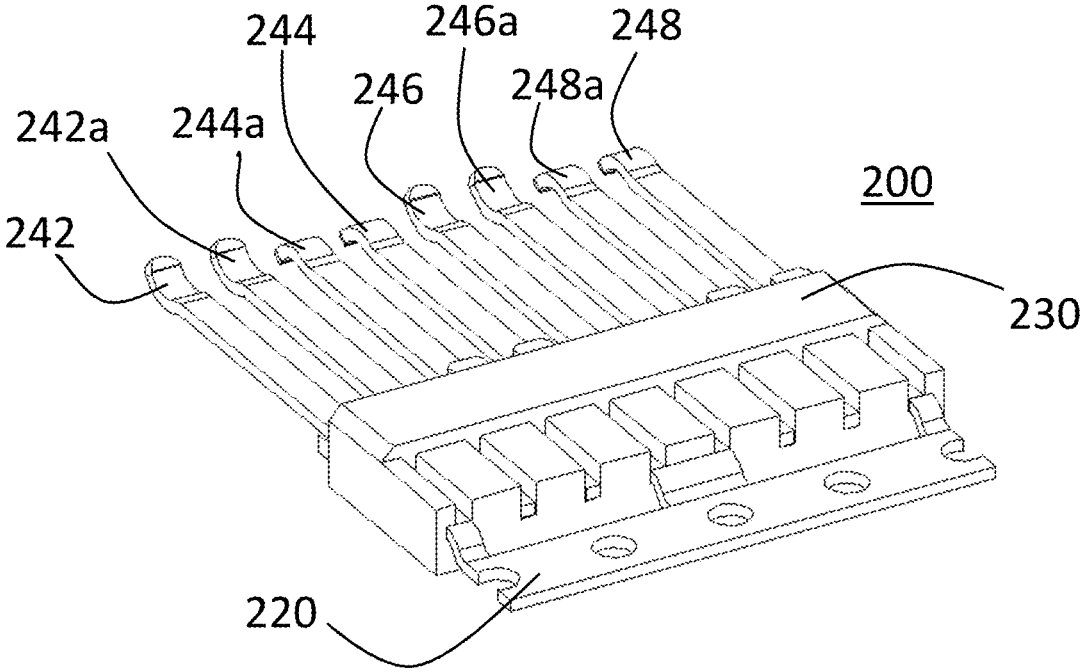
FIG. 2B is a perspective view of a termination subassembly for a high speed data contact set in accordance with a preferred embodiment of the present invention.

The high speed data module insert has a termination subassembly 200, shown in FIG. 2B. A sheet 210 of contacts are formed by known means. On the sheet, the contacts are formed in a load balanced alternating two up/two down pattern. As will be described later, this pattern allows the high speed data module insert to be hermaphroditic. A set of eight contacts 242, 242*a*, 244*a*, 244, 246, 246*a*, 248*a*, 248 is cut from the sheet 210, the set having the two up two down pattern of contacts. The eight contact beams in the set initially are connected to one another by shield 220. The eight contact beams are in a row (wafer shape) and can carry differential signal pairs at speeds of 10 Gigabits per second. A termination subassembly body 230 is molded on and around the contacts as shown in FIG. 2B. The termination subassembly body is formed of a non-conductive or insulating material such as plastic. After molding of the insert body assembly 230 onto the contact set all of the contacts, or a subset such as four of the contacts 242*a*, 244*a*, 246*a* and 248*a*, are disconnected from the shield 220. Some contact, such as contacts 242, 244, 246 and 248 could connected to one another by the shield by cutting the beams adjacent the shield. The contacts are direct welded to pins 252, 252*a*, 254, 254*a*, 256, 256*a*, 258 and 258*a*. The direct welded termination allows for optimum electrical performance enabling high data rates. High data rates are achieved because the direct welding fused the standard industry cable conductor material directly to the contact beams without introduction of another material such as solder. While the direct welding is preferred, other types of connected besides direct welding may be used. The termination subassembly is compatible with most standard industry connectors and cables, including but not limited to USB, HDMI, SATA, RJ45, Gigabit Ethernet, DVI and QSFP.

In FIGS. 1A through 1C, the termination subassembly 200 is shown in a position inserted in the housing 100 to form the high speed data module insert. The protective arms 120*a*, 120*b*, 120*c* and 120*d* each cover one side of a pair of contacts. In this manner the shroud protects the contact beams. Viewed from the top as shown in FIG. 1A, contact pairs 244*a*, 244 and 248*a*, 248 are exposed while contact pairs 242, 242*a* and 246, 246*a* are respectively covered by protective arms 120*a* and 120*c*. Viewed from the bottom one would see the inverse with contact pairs 242, 242*a* and 246, 246*a* exposed and contact pairs 244*a*, 244 and 248*a*, 248 covered by protective arms 120*b* and 120*d* respectively.

Figure 3:
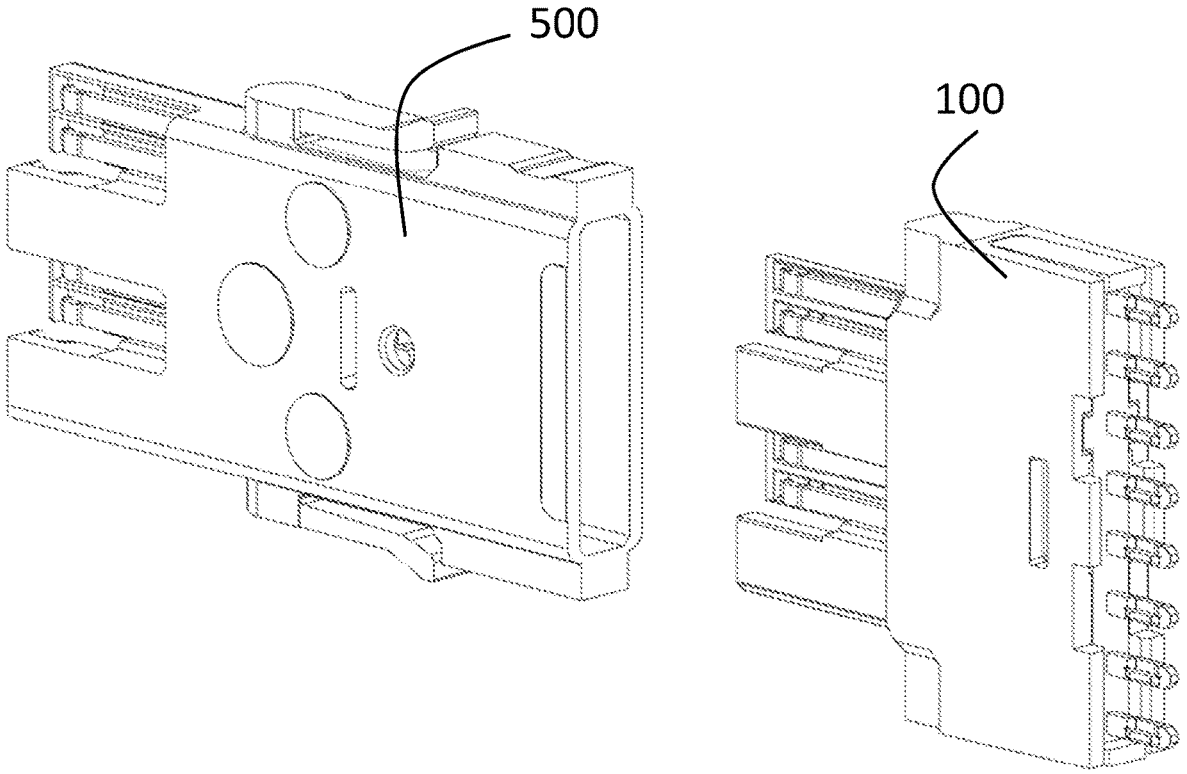
FIG. 3 is a perspective view of a high speed data module vertical insert and a high speed data module pass-thru insert in accordance with a preferred embodiment of the present invention.

In FIG. 3 the high speed data module vertical insert is shown positioned to mate with a high speed data contact set 500 such as is disclosed in U.S. Pat. No. 9,246,286.

Figure 4:
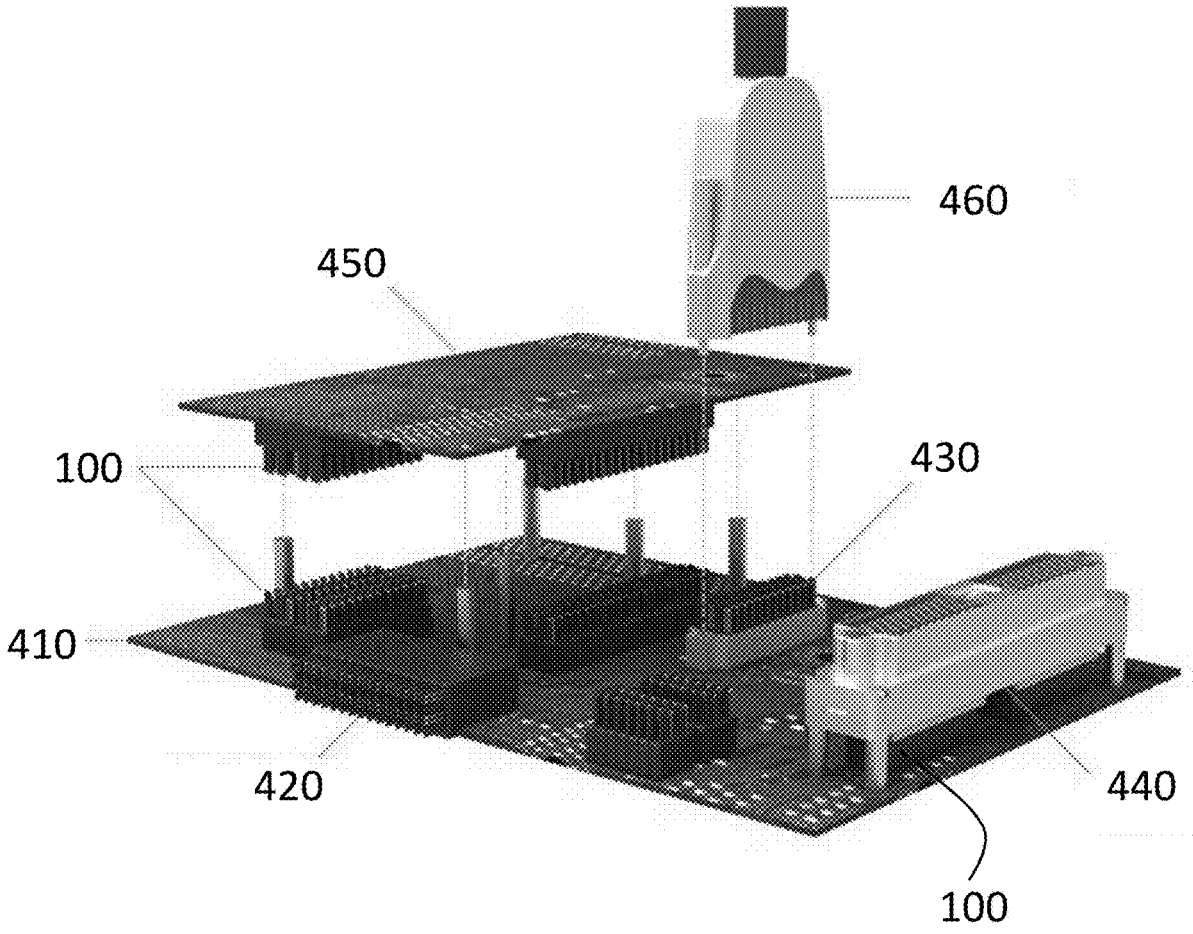
FIG. 4 is a perspective view of a PCB mountable high speed data module vertical insert in accordance with a preferred embodiment of the present invention.

FIG. 4 is a perspective view of a PCB mountable high speed data module vertical insert in accordance with a preferred embodiment of the present invention. A PCB board 410 has a plurality of high speed data module vertical inserts 100 connected to it. A plurality of high speed data module right angle inserts 420 such as are disclosed in U.S. Pat. No. 9,685,727 also are shown connected to the PCB board 410. Further attached to the PCB board are a vertical header 430, a high speed data module 440 mounted in a plurality of high speed data module vertical insert 100, a secondary PCB board 450 also mounted on a plurality of high speed data module vertical inserts 100 and a welded wire high speed data module 460 such as is disclosed in U.S. Pat. No. 9,685,727.

Figure 5:
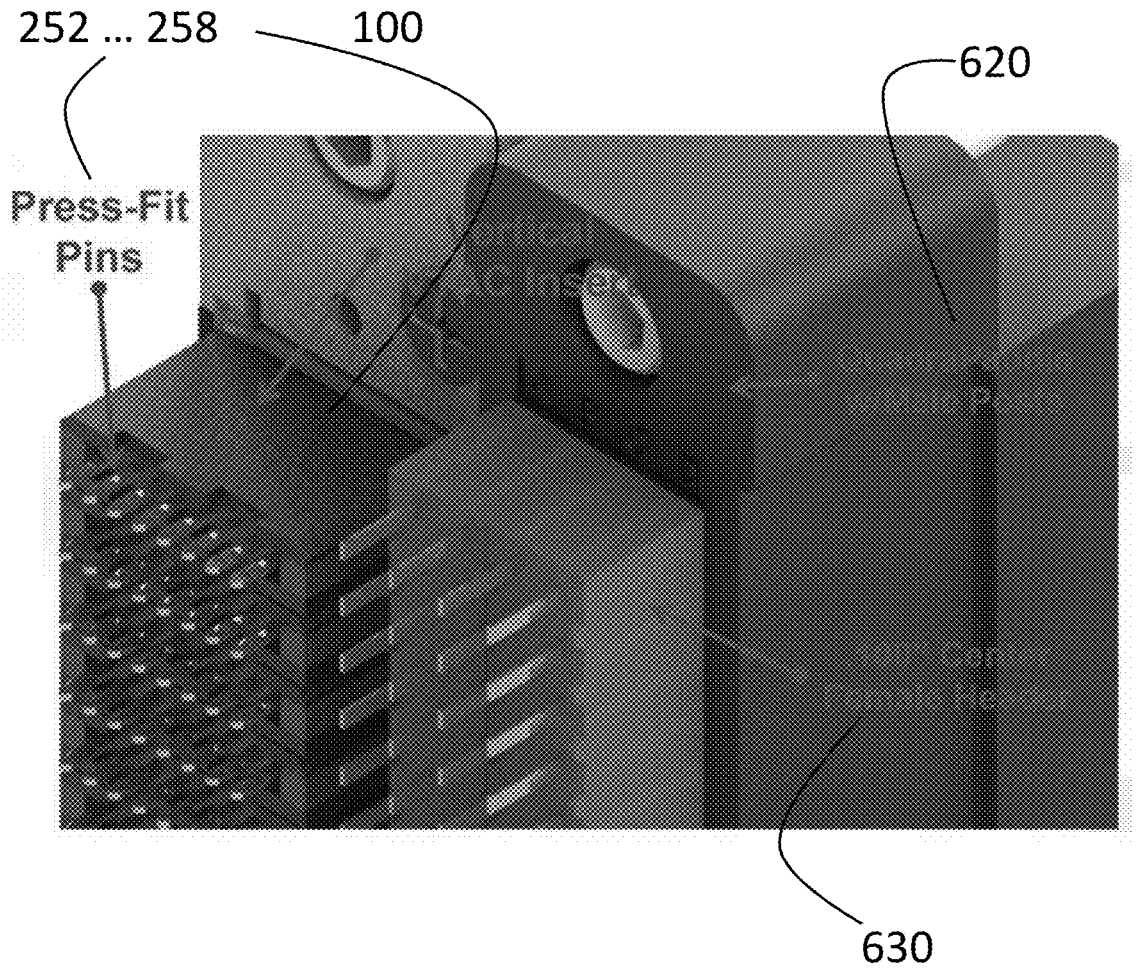
FIG. 5 is a close-up perspective view of a high speed data module vertical insert in accordance with a preferred embodiment of the present invention loaded with contacts.

FIG. 5 is a close-up perspective view of a high speed data module vertical insert in accordance with a preferred embodiment of the present invention loaded with contacts. In. FIG. 5, high speed data module vertical inserts 100 with press-fit pins 252 . . . 258*a* are shown along with a module 620 and female header 630.

Figure 6:
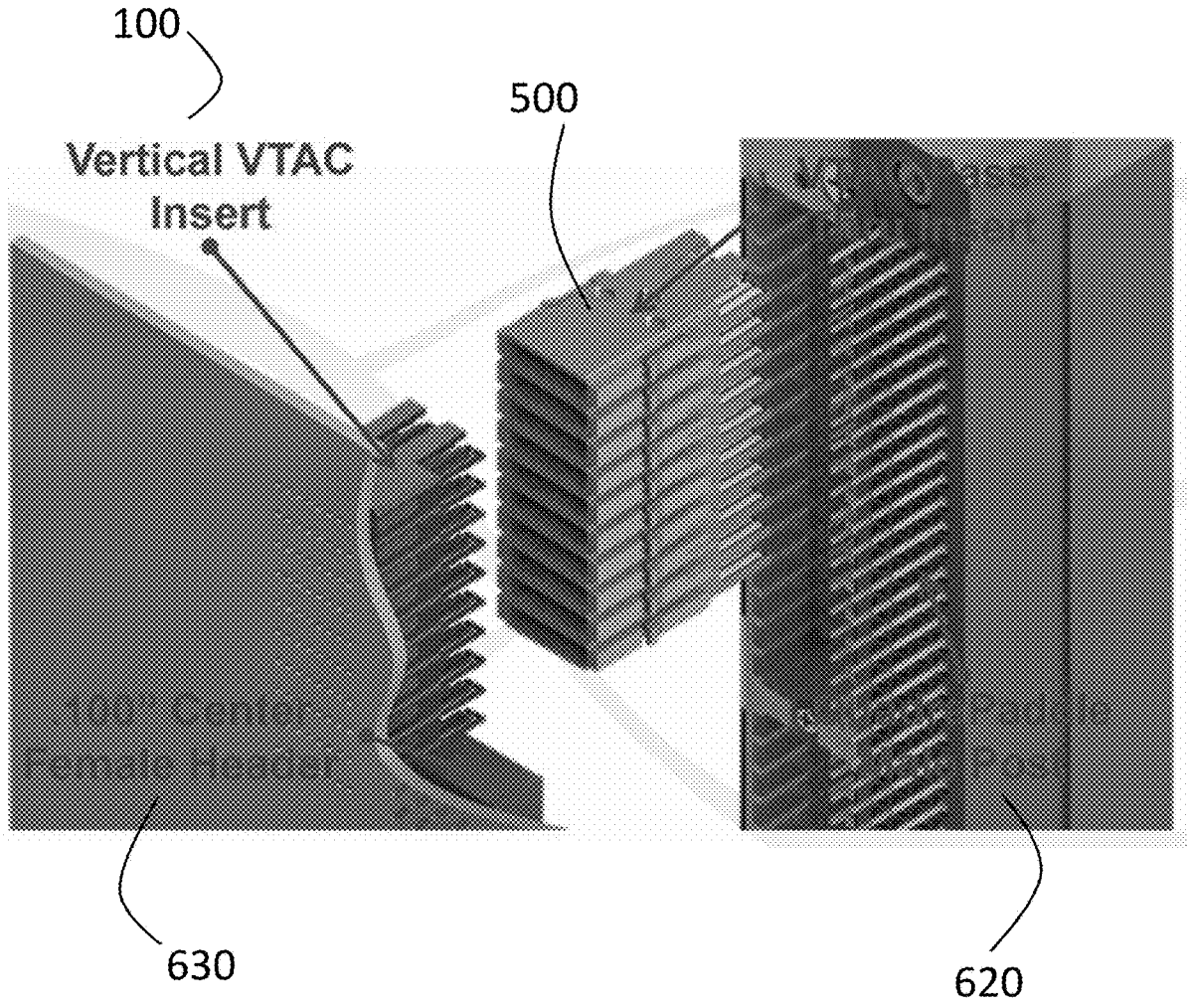
FIG. 6 is a perspective view of a stack of PCB mountable high speed data module vertical inserts and pass-thru inserts in accordance with a preferred embodiment of the present invention.

FIG. 6 is a perspective view of a stack of PCB mountable high speed data module vertical inserts and pass-thru inserts in accordance with a preferred embodiment of the present invention. FIG. 6 shows an arrangement with a female header 630, a stack of high speed data module vertical inserts 100, a stack of high speed data sets 500 and a module 620 with male posts.

Figure 7:
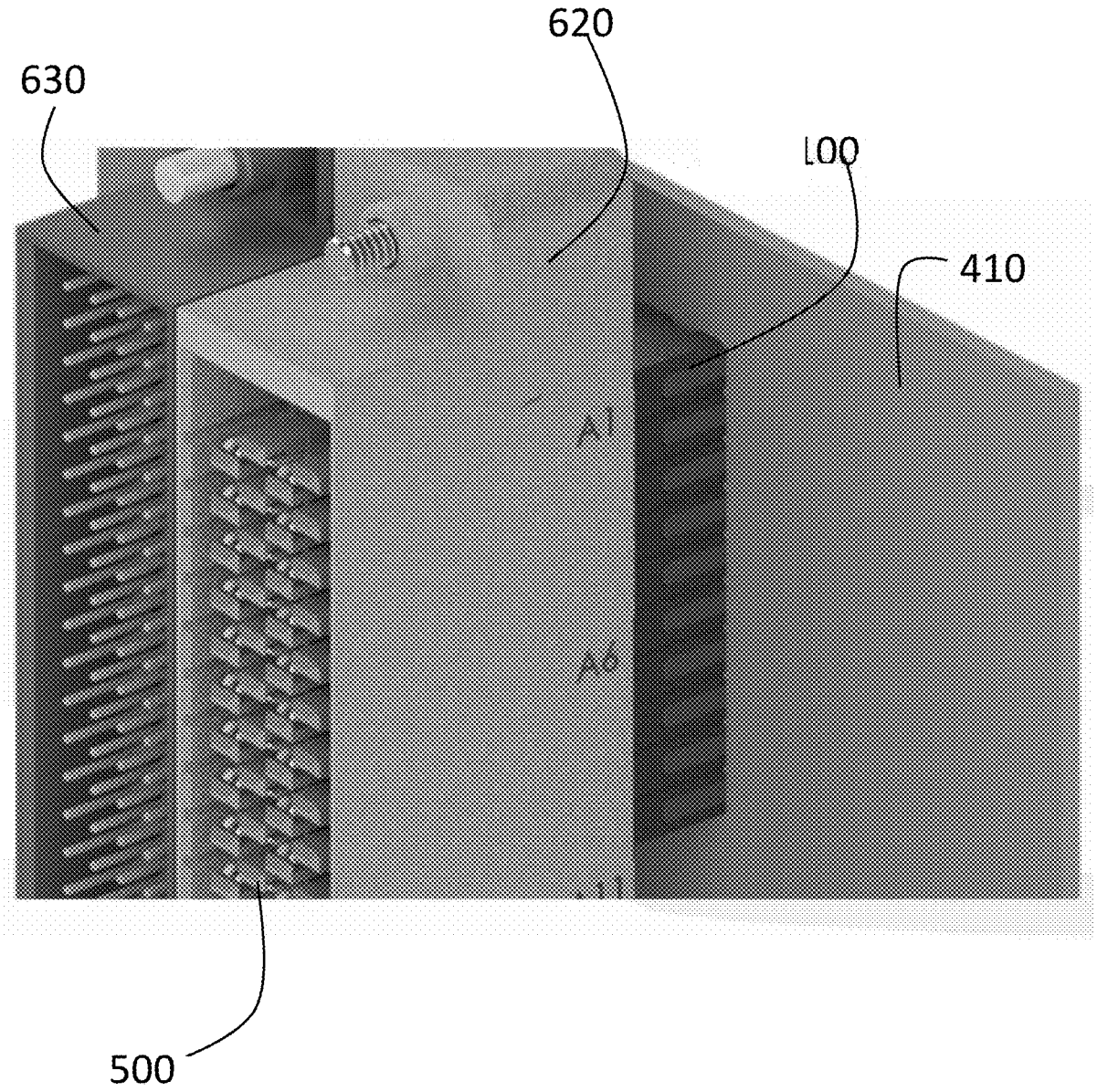
FIG. 7 is a perspective view of a stack of PCB mountable high speed data module vertical inserts loaded in a module in accordance with a preferred embodiment of the present invention.

FIG. 7 shows another arrangement of a stack of PCB mountable high speed data module vertical inserts 100 loaded in a module 620 in accordance with a preferred embodiment of the present invention.

Figure 8:
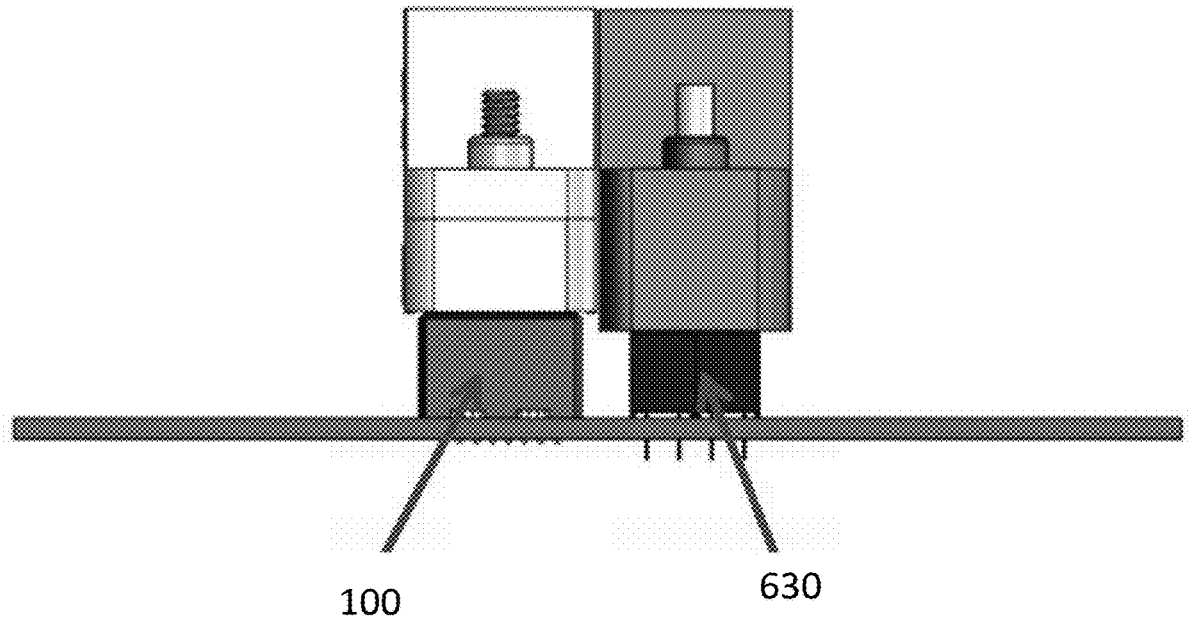
FIG. 8 is a side view of a PCB mountable high speed data module vertical insert on a PCM board in accordance with a preferred embodiment of the present invention.

FIG. 8 is a side view of a PCB mountable high speed data module vertical insert on a PCM board in accordance with a preferred embodiment of the present invention.

The foregoing description of the preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

What is claimed is:

1. A high speed data contact assembly comprising:

a printed circuit board, a plurality of high speed data contact sets, each high speed data contact set comprising:

a housing comprising:

a hollow body having a top, a bottom, a distal end, a proximal end, and first side and a second side; and a termination subassembly in said hollow body, said termination subassembly comprising:

a plurality of pairs of parallel contact beams, the contact beams in each pair being of the same orientation and the pairs of contact beams having alternating orientations, wherein each contact beam has a distal end having a first orientation and a proximal end having a second orientation opposite of said first orientation; and a plurality of high speed data module vertical insert adapted for insertion into said proximal end of said high speed data contact set, said high speed data module vertical insert comprising:

a vertical insert housing; and a vertical insert contact insert assembly in said vertical insert housing, said vertical contact insert assembly comprising:

a plurality of contact beams each having a distal end and a proximal end; and molding a body over said plurality of contact beams;

wherein a first end of each of said plurality of high speed data module vertical inserts is inserted into a proximal end of one of said plurality of said high speed data module contacts sets and a second end of each of said plurality of high speed data module vertical inserts is connected to said printed circuit board.

2. The high speed data contact assembly according to claim 1, wherein said high speed data contact set is hermaphroditic.

3. The high speed data contact assembly according to claim 1, further comprising potting material in said housing of said high speed data module vertical insert.

4. The high speed data contact assembly according to claim 1, wherein said body comprises plastic.

5. A high speed data contact assembly comprising:

a printed circuit board; and a plurality of high speed data module vertical insert adapted for insertion into said proximal end of said high speed data contact set, said high speed data module vertical insert comprising:

a vertical insert housing; and a vertical insert contact insert assembly in said vertical insert housing, said vertical contact insert assembly comprising:

a plurality of contact beams each having a distal end and a proximal end; and molding a body over said plurality of contact beams;

wherein one end of each high speed data module vertical insert is connected to said printed circuit board.

* * * * *